US007613420B2

(12) United States Patent
Murrell et al.

(10) Patent No.: US 7,613,420 B2
(45) Date of Patent: Nov. 3, 2009

(54) UNIFORM ENTRY OF MEDIA INTO AN ALIGNMENT NIP

(75) Inventors: Niko J. Murrell, Lexington, KY (US); Daniel L. Carter, Georgetown, KY (US)

(73) Assignee: Lexmark International, Inc., Lexington, KY (US)

( * ) Notice: Subject to any disclaimer, the term of this patent is extended or adjusted under 35 U.S.C. 154(b) by 87 days.

(21) Appl. No.: 11/063,821

(22) Filed: Feb. 23, 2005

(65) Prior Publication Data

US 2006/0188305 A1 Aug. 24, 2006

(51) Int. Cl.
*G03G 15/16* (2006.01)

(52) U.S. Cl. ..... 399/316; 399/388; 399/391; 399/392

(58) Field of Classification Search ..... 399/391, 399/388, 401, 192, 316
See application file for complete search history.

(56) References Cited

U.S. PATENT DOCUMENTS 4,662,765 A * 5/1987 Kapp et al. ..... 400/595
5,022,642 A 6/1991 Hasegawa et al.
5,043,771 A * 8/1991 Shibata et al. ..... 399/396
5,155,537 A 10/1992 Komatsu et al.
5,201,873 A * 4/1993 Kikuchi et al. ..... 271/9.13
5,225,881 A * 7/1993 Goto et al. ..... 399/402
5,357,329 A * 10/1994 Ariyama et al. ..... 399/16
5,383,654 A 1/1995 Iseda
5,449,164 A * 9/1995 Quesnel et al. ..... 271/186
5,539,510 A * 7/1996 Yamashiro et al. ..... 399/9
5,581,289 A 12/1996 Firl et al.
5,775,684 A 7/1998 Jackson et al.
5,785,308 A 7/1998 Flores et al.
5,839,032 A * 11/1998 Yasui et al. ..... 399/124
5,890,707 A 4/1999 Allibert et al.
5,933,697 A * 8/1999 Onodera et al. ..... 399/406
6,019,361 A * 2/2000 Tanjo et al. ..... 271/3.19
6,029,970 A 2/2000 Hwang
6,152,561 A 11/2000 Watanabe
6,215,970 B1 * 4/2001 Yoshikawa et al. ..... 399/124
6,273,414 B1 8/2001 Matsuo
6,293,541 B1 9/2001 Horiuchi et al.
6,493,534 B2 * 12/2002 Sawanaka et al. ..... 399/316
6,527,267 B1 3/2003 Kuwata et al.
6,644,651 B2 11/2003 Allsup
6,733,008 B2 5/2004 Waragai et al.
6,764,070 B2 7/2004 Masotta et al.
6,785,508 B2 * 8/2004 Jeong ..... 399/401
6,974,128 B2 * 12/2005 Quesnel ..... 271/227
7,272,351 B2 * 9/2007 Murrell et al. ..... 399/316

* cited by examiner

*Primary Examiner*—Judy Nguyen
*Assistant Examiner*—Matthew G Marini
(74) *Attorney, Agent, or Firm*—Coats & Bennett, P.L.L.C.

(57) ABSTRACT

Alignment nip regulation may be implemented by controlling the approach of media to an alignment nip. Where media is fed from a plurality of sources and from a plurality of approach angles through a common alignment nip, nip entry may be controlled by focusing the media through a diverter or a jog in an existing path to alter the course followed by the media sheets. The diverter may be configured to direct the media sheets to a contact point at or near the alignment nip, such as on a roller that forms the alignment nip. Alternatively, media sheets arriving at the nip from separate conduits may be separately directed to a common contact point near the alignment nip. In either case, one or more sensors may detect the approach of the media sheets at a time when the sheets are a common, predetermined distance away from the alignment nip.

19 Claims, 4 Drawing Sheets

UNIFORM ENTRY OF MEDIA INTO AN ALIGNMENT NIP

BACKGROUND

A persistent goal of many image forming devices is precise registration of images formed on media sheets. This may be particularly true of color printers using multiple color cartridges to create a single color image. In an effort to improve image registration, many image forming devices use an alignment mechanism to control the position and timing of media sheets traveling from various media sources, through the media path, and to the image forming location within the device. Thus, the image forming device relies on the alignment mechanism, which may include a variety of optical, electrical, or mechanical sensors, to know precisely where to form an image on the sheet.

As image forming devices are incorporated in smaller packages, rigid space constraints on the media transport components within the device create problems for devices having multiple feed sources. One example of this type of device is a laser printer with multiple media trays, a duplex path, and perhaps a manual feed path. Devices such as these may route media sheets from each of these sources through a common media path. As these devices become smaller, so too does the internal space used to align media fed from the multiple sources into the common media path.

A disadvantage of smaller device packaging is that, in general, more space and longer paths are desirable to accurately direct media sheets that are fed from multiple sources toward a common alignment point. Where sufficient space is available, the various media paths can be gradually merged to a common path so that sheets traveling in this common path may then repeatably arrive at a common alignment point. Further, with sufficient spacing, sheets arriving at this common alignment point may be sensed using a single leading edge sensor or other equivalent sensor. Thus, the timing of image processing and media transport events may be predictably determined. Thus, given sufficient space, the fact that media sheets arrive at the common alignment point from media paths converging from different directions and different approach angles may be nearly irrelevant.

Unfortunately, as image forming devices get smaller, alignment nips, rollers, and other alignment points move closer to the various media sources. Consequently, the distances previously relied on to align media from different sources get smaller and it has become increasingly difficult to provide consistent media sheet entry into these alignment points. Other factors such as media curl, media weight, and environmental conditions make it even more difficult to reliably control where the leading edge of a media sheet contacts the alignment point. For example, in an alignment nip formed at the contact surface between two registration rollers, the above factors may contribute to the leading edge of media sheets unpredictably striking either roll or both rolls simultaneously, leading to feed reliability problems such as skew, folding, or treeing.

Furthermore, the timings for each media source may not be consistent. With the sheets approaching the alignment point from varying angles and the leading edge of the sheets contacting the alignment point at different locations, the time that elapses between sensing a leading edge approaching the alignment point and passing of the leading edge through the alignment point may vary drastically. Thus, transport and image processing algorithms must accommodate this variation by implementing different feed times for the different sources or implementing large delay windows to account for the various feed times, neither of which is optimal.

SUMMARY

Embodiments of the present invention relate to controlling the approach and entry of media to an alignment nip as may be formed between alignment or registration rollers. Media sheet approach may be controlled with a conduit through which media sheets originating from a plurality of sources pass. The conduit may be positioned adjacent and upstream of an alignment nip. The conduit may comprise a diverting path or jog to alter the course followed by the media sheets passing through the conduit to focus the approach of the media sheets toward the alignment nip. The diverting path may alter an angle of approach of the media sheets to the alignment nip. The diverting path may also improve the likelihood that media sheets from the various sources contact the alignment nip at a repeatable point. In an exemplary system where the alignment nip comprises a contact area between a driven roller and a drive roller, the diverting path may be configured to direct the media sheets to a contact point at the alignment nip or to a point on the drive or driven rollers.

Other embodiments comprise separate conduits through which media sheets pass in approaching the alignment nip. The separate conduit may also be configured to direct media sheets to a common contact point near the alignment nip. The alignment nip may also have an associated media sensor associated with each media sheet path. The sensor, an example of which is a leading edge sensor, may be adapted to trigger when a leading edge of a media sheet traveling through either the media sheet paths passes a substantially common distance away from the common point at the alignment nip.

DETAILED DESCRIPTION

Figure 1:
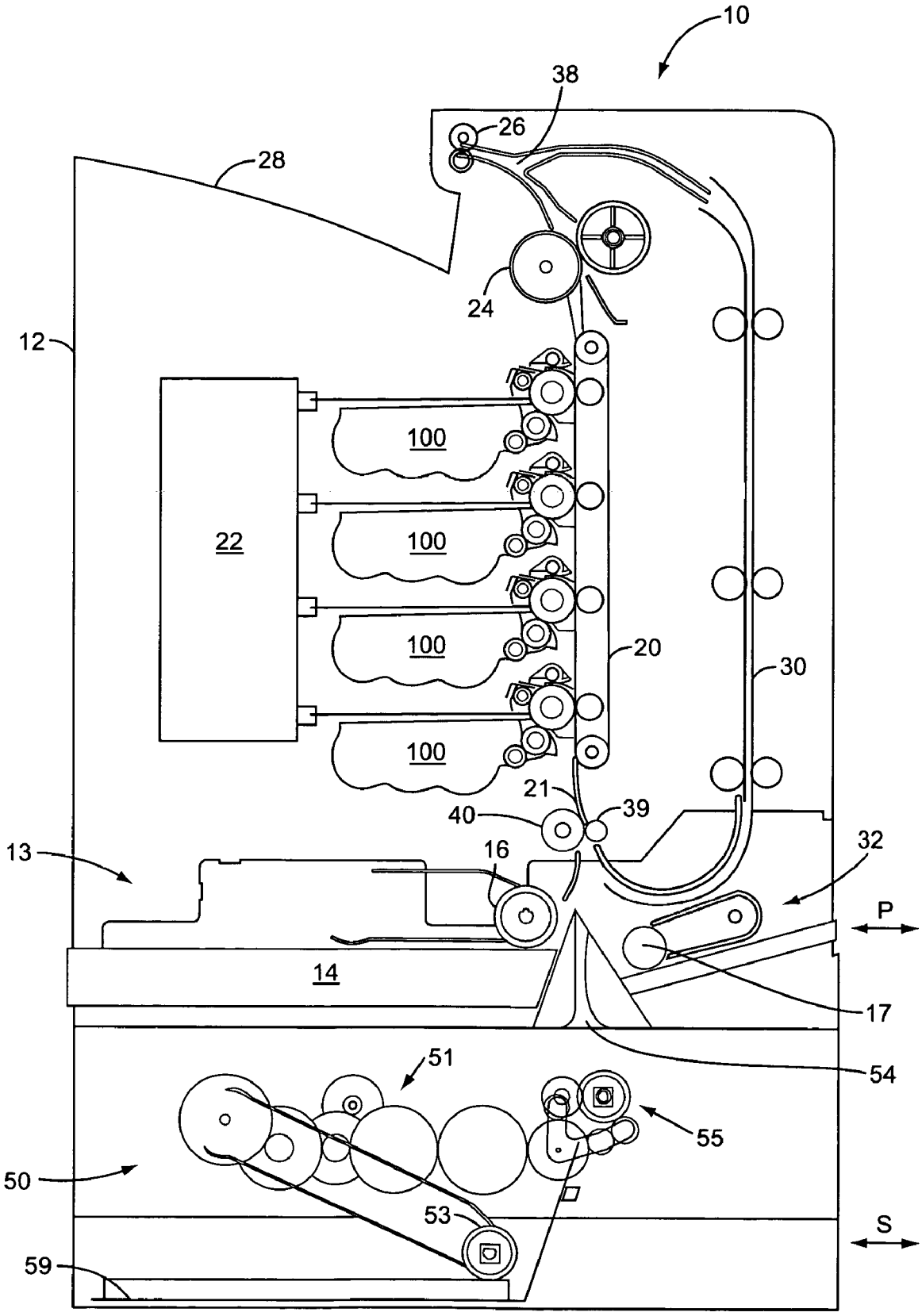
FIG. 1 is a schematic illustration of an image forming device according to one embodiment of the present invention.

Embodiments of the present invention are directed to media alignment in an image forming apparatus. One application of the embodiments disclosed herein is for moving media sheets from a plurality of sources into an image forming path within an image forming apparatus as generally illustrated in FIG. 1. FIG. 1 illustrates a representative image forming device, such as a printer, according to one embodiment of the present invention and is indicated generally by the numeral 10. The exemplary image forming device 10 comprises a main body 12, at least one media input section 13 holding a print media tray 14, a pick mechanism 16, registration rollers 39,40, a media transport belt 20, a printhead 22, a plurality of image forming stations 100, a fuser roller 24, exit rollers 26, an output tray 28, and a duplex path 30. The components and operation of image forming device 10 are conventionally known; however, a brief discussion is included below for clarity.

The image forming device 10 of FIG. 1 includes a first input section 13, a manual input section 32, and optionally, a second input section 50. Multiple input sections allow for storing or introducing multiple types and sizes of media that may be picked and fed into the media path 21 as required. The input sections may also be sized to hold a large capacity of media sheets. The first input section 13 includes a media tray 14 with a pick mechanism 16 to introduce media sheets into the media path 21 responsive to the receipt of a pick command. The manual input section 32 may also be located in a main body 12 to introduce media sheets into the media path 21. Manual input section 32 includes an associated pick mechanism 17 to feed media sheets introduced by a user from outside the body 12 of image forming device 10. A second input section 50 is located in or adjacent to the main body 12 below the first media tray 14. The second input section 50 includes a third pick mechanism 51, including pick roller 53, that picks sheets from input tray 59. In one embodiment, the input tray 59 has a larger capacity than tray 14 to hold a greater number of sheets. For example, input tray 59 may have a capacity of 500 sheets versus 250 sheets for tray 14. Feed rollers 55 are located downstream from the pick mechanism 51 to receive the sheets and forward them through input path 54 towards the media path 21. The media trays 14, 59 may be removable as indicated by arrows P and S for refilling, and located on a lower section of the device 10.

From the various input sections 13, 32, 50 and their associated media paths, media sheets are fed into the media path 21. One or more registration rollers 39, 40 disposed along the media path 21 align the media sheet and precisely control its further movement. A media transport belt 20 forms a section of the media path 21 for moving the media sheets past a plurality of image forming units 100. In a typical color electrophotographic printer such as exemplary device 10, three or four colors of toner—cyan, yellow, magenta, and optionally black—are applied successively to a print media sheet to create a color image. Correspondingly, the embodiment of FIG. 1 depicts four image formation stations 100 arrayed along a media transport belt 20. The transport belt 20 carries the media sheet successively past the image formation stations 100. At each station 100, imaging device 22 forms a latent image onto an associated photoconductive member or PC drum. The latent image is then developed by applying toner to the PC drum. The toner is subsequently deposited on the media sheet as it is conveyed past the image formation station 100.

Once the media sheet moves past the image forming stations 100, a fuser 24 thermally fuses the loose toner to the media sheet. The sheet then passes through reversible exit rollers 26 to the output stack 28 formed on the exterior body 12 of image forming device 10. Alternatively, the exit rollers 26 may reverse motion after the trailing edge of the media sheet has passed the entrance to a duplex path 38, thus directing the media sheet through the duplex path 30 and again into media path 21 to print a duplex image on the opposite side of the media sheet. It should be understood that while the foregoing description relates to a color electrophotographic printer as shown in FIG. 1, the present invention is not limited to color printers, but may be advantageously applied to other types of image forming devices 10, including but not limited to, single-color laser printers and inkjet printers.

Figure 2:
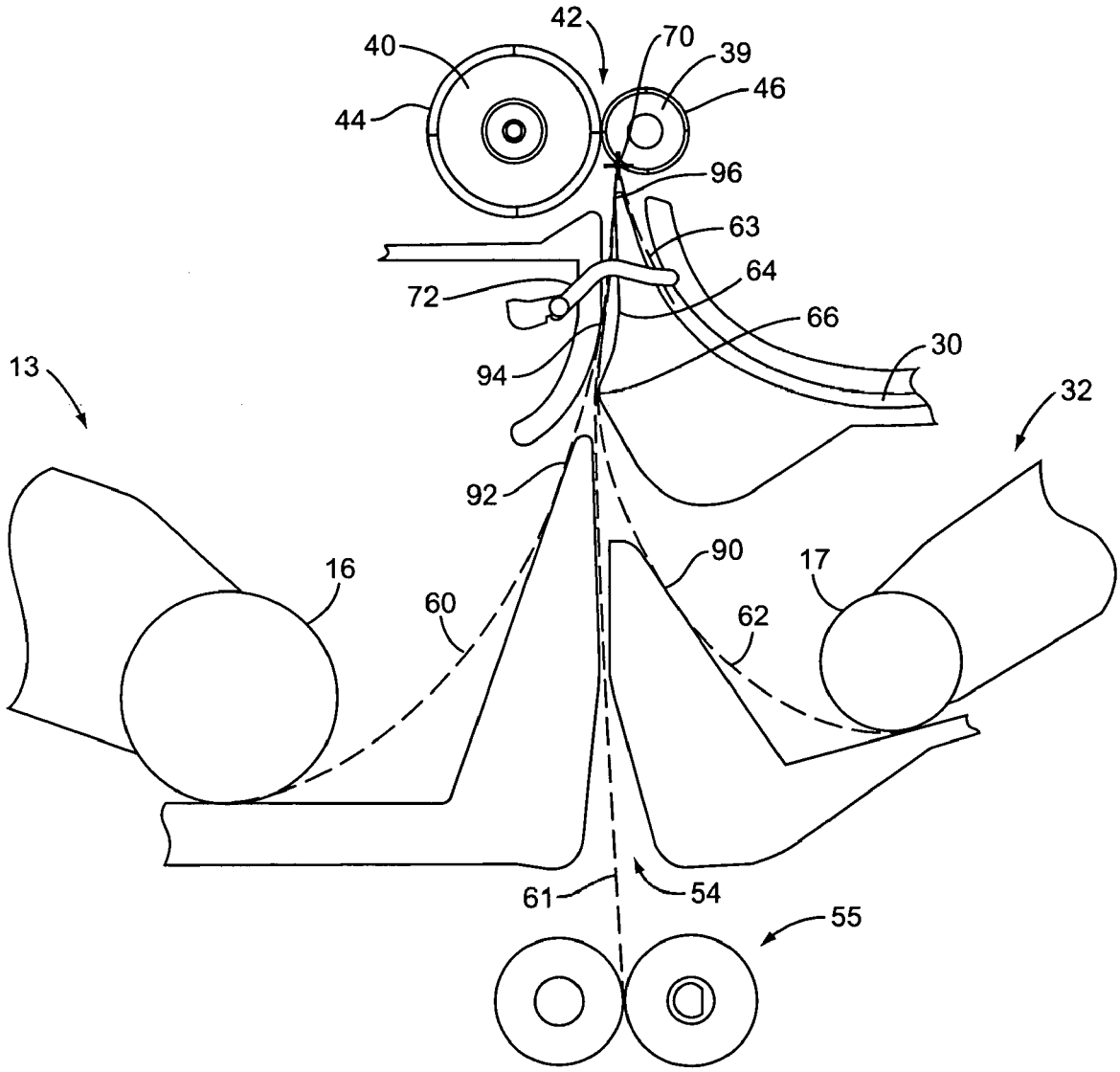
FIG. 2 is a schematic illustration of media feed paths in the vicinity of an alignment nip according to one embodiment of the present invention.

Referring to FIGS. 1 and 2, the registration rollers 39, 40 may advantageously perform an alignment process whereby the leading edge of a media sheet is generally held in a fixed location for a predetermined period of time before passing the media sheet through the rollers 39, 40 toward the media path 21 and transport belt 20. The rollers 39, 40 form a nip 42, shown specifically in FIG. 2, at the contact area between the rollers that is sometimes referred to as an alignment nip, metering nip, or registration nip as representative of this process. The media alignment may consist of a bump alignment process, which forms a buckle in the media sheet immediately upstream of the alignment nip 42. During simplex printing (e.g., printing on a first side of a sheet fed from input sections 13, 32, 50), a media sheet is moved by a pick roller 16, 17 or a feed-through roller 55 to the alignment nip 42. In duplex printing, media sheet is moved through duplex path 30 to the alignment nip 42. For either case, the registration rollers 39, 40 rotate in a reverse direction as the leading edge of the media sheet reaches the rollers 39, 40. This reverse rotation laterally aligns the media sheet relative to the alignment nip 42 prior to passing the sheet to media path 21 for image formation. The pick roller 16, 17, drive through roller 55, or duplex path 30 rollers, however, continue to feed the media sheet towards the alignment nip 42. As a result, a "buckle" forms in the sheet as the leading edge of the sheet bumps up against the alignment nip 42. After a predetermined time, the registration rollers 39, 40 reverse and begin to rotate in a forward direction to convey the sheet to the media path 21.

FIG. 2 shows a more detailed schematic of various feed paths 60-63 approaching registration rollers 39, 40 and alignment nip 42. In the illustrated embodiment, feed path 60 is followed by media fed to alignment nip 42 by pick roller 16 in the primary input source 13. Feed path 61 is followed by media fed to alignment nip 42 through media path 54 from the second input source 50 (see FIG. 1). Feed path 62 is followed by media fed to alignment nip 42 by pick roller 17 from the manual input source 32. Feed path 63 is followed by media fed to alignment nip 42 through the duplex path 30.

In one embodiment, the registration rollers 39, 40 are comprised of a drive roller 40 and a backup roller 39. The drive roller 40 is rotated by a drive motor and, optionally, an associated drive mechanism (not shown). The backup roller 39 may also be rotated by a drive motor, but is more advantageously rotated by frictional forces created by contact with the drive roller 40 at the nip 42. Thus, backup roller 39 operates as a follower roller that rotates in a direction opposite to that of drive roller 40. Friction between the rollers 39, 40 may be increased by incorporating a material having a high coefficient of friction on one or both of the outer surfaces 46, 44 of the rollers 39, 40. In addition, the nip force between the rollers 39, 40 may be increased with a bias member such as a spring. For reasons discussed in greater detail below, the outer surface 46 of backup roller 39 is preferably comprised of a wear-resistant material such as a hardened resin, composite, steel, or other metal.

In the exemplary embodiment, media sheets traveling along feed paths 60-62, which originate from widely different directions, are routed through a common channel or conduit 64 prior to reaching alignment nip 42. Routing these feed paths in a converging manner like this improves the likelihood that media following these paths will reach a common point at the alignment nip 42, such as focal point 70 on backup wheel 39 (or on drive wheel 40 or at the nip 42). A diversion or jog 66 in the conduit 64 further diverts the sheets traveling through the conduit 64 so that the leading edge of sheets following paths 60-62 contacts focal point 70. Diversion 66 tends to harmonize the direction from which the media paths 60-62 approach the focal point 70 in addition to normalizing the point of contact 70 at or near the alignment nip 42. In the absence of conduit 64 and diversion 66, the media paths 60-62 are more likely to contact other areas around alignment nip 42, including on drive wheel 40 or at the nip 42 itself. The diversion 66 and conduit 64 also advantageously operate to prevent media sheets from missing the nip altogether, as would happen, for example, if a leading edge of a media sheet were to contact a right side of backup wheel 39 shown in FIG. 2.

In the exemplary embodiment, diversion 66 may alter the direction followed by heavy-weight sheets fed from pick roller 16 along path 60. Diversion 66 may also alter the direction followed by media sheets on paths 61-62 to more closely follow that of path 60. For example, in FIG. 2, diversion 66 may alter the paths 61-62 towards the left, perhaps even to the left of focal point 70. This is not to say that media paths 60-62 are always identical between the diversion 66 and focal point 70, though they may be. It is more likely that, because of the inherent beam stiffness and weight in media, media paths 60-62 will follow a different course between the diversion 66 and the focal point 70. For instance, in one embodiment, sheets following media path 62 contact the various media guides between pick roller 17 and backup roller 39 at four contact points 90, 94, 96, and diversion 66. Thus, sheets following media path 62 may conform to a four (or more)-point spline curve in the vicinity of conduit 64. A media sheet moving along path 61 also encounters multiple contact surfaces including diversion 66, and points 94, 96. Likewise, path 60 encounters points 92, 94, and 96.

With the media constrained as described along paths 60-62, individual sheets may also be ironed out in a widthwise (or perpendicular to the direction of travel) direction. In one embodiment, the media sheets may be intentionally directed at contact point 96 immediately prior to contacting the alignment roller 39 to eliminate leading edge curl effects such as dog ears, treeing, nip stubs and the like.

In addition to media paths 60-62 converging at focal point 70, media path 63 from duplex path 30 also advantageously converges at the focal point. In certain document handling devices, such as the exemplary embodiment shown, space constraints may prevent certain feed paths from being routed through a common conduit 64. As an alternate or parallel solution to the inherent problem of alignment nip 42 approach, certain paths may be directed individually or in groups to a common focus point 42. Thus, in the embodiment provided, whereas three feed paths 60-62 are diverted through conduit 64 and past diversion 66, one feed path 63 is routed to focal point 70 outside of conduit 64 and diversion 66. For instance, with sufficient space, duplex path 30 and paper path 63 may also be routed through conduit 64. Alternatively, paths 62, 63 might be combined and routed to focal point 70 independent of paths 60, 61. Certainly other combinations of individual or grouped media paths may be utilized depending on the particular application.

Figure 3:
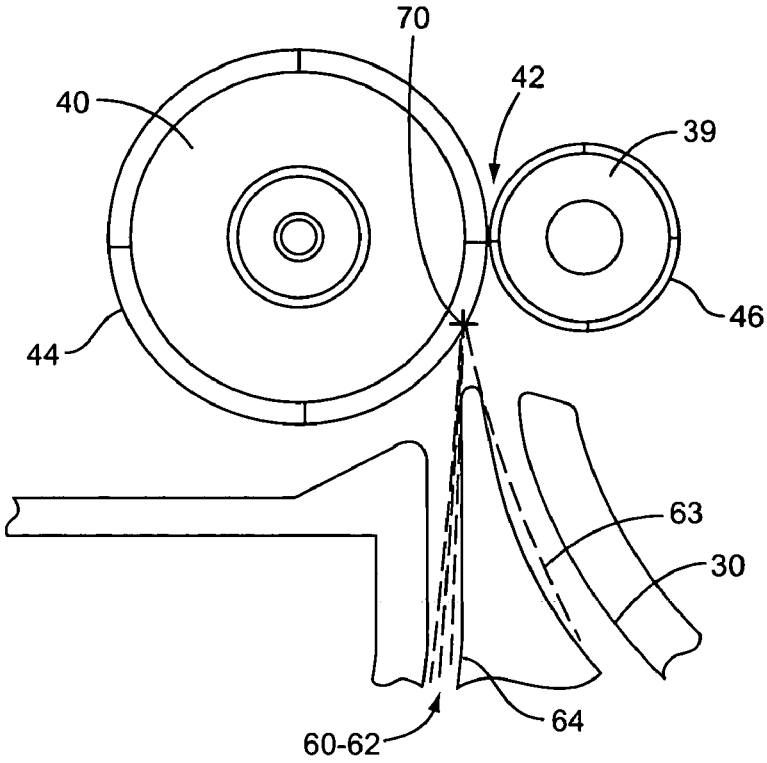
FIG. 3 is a schematic illustration of media feed paths in the vicinity of an alignment nip according to one embodiment of the present invention.

As alluded to above, the focal point 70 in the present embodiment is positioned on a surface 46 of roller 39. The focal point 70 may also be positioned at other locations in the vicinity of the nip 42, such as on drive wheel 40, as shown in FIG. 3, or at the nip 42. Also discussed above was that the outer surface 44, 46 of one or both the drive wheel 40 and backup wheel 39 may be covered with a high-friction surface to induce rotation in a non-driven, follower wheel such as backup wheel 39. With wear considerations in mind, the surface 46 on which the focal point 70 is located, may advantageously be constructed of a wear resistant material, such as steel, steel alloy, or other hardened material. Thus, persistent contact of the leading edge of sheets at the focal point 70 will not prematurely lead to dimples or scratches on the surface 46 of backup roller 39.

Figure 4:
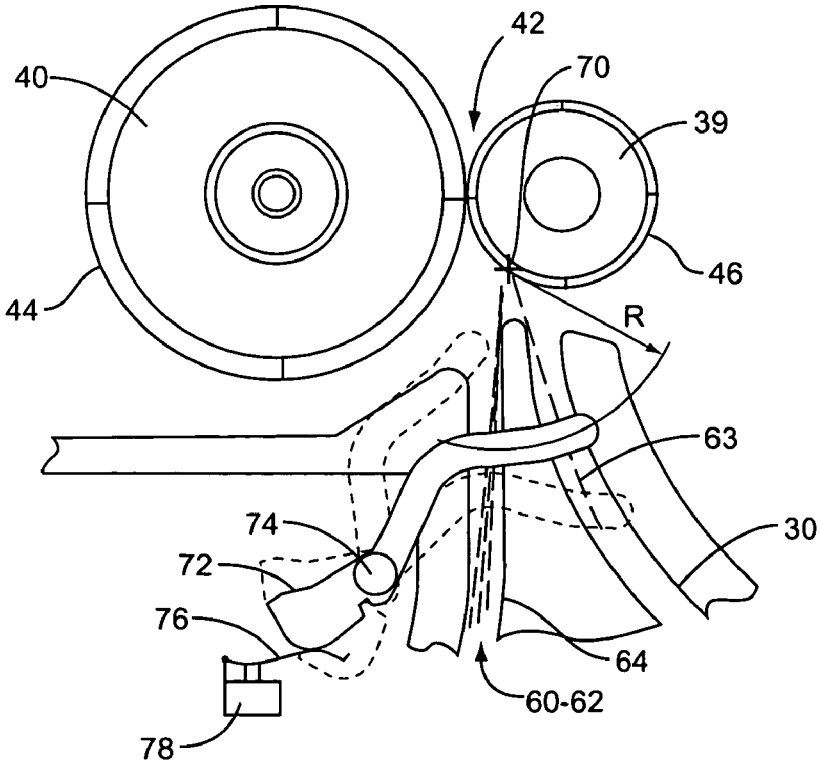
FIG. 4 is a schematic illustration of a media feed sensor in the vicinity of an alignment nip according to one embodiment of the present invention.

A sensor 72, shown in FIG. 2 and more clearly in FIG. 4, may be associated with the alignment nip 42 to sense the approach of media traveling along media paths 60-63. The sensor 72 advantageously informs the image forming device 10 of the presence of an approaching media sheet to begin a timing sequence used in controlling further transport and image processing. The exemplary sensor 72, which comprises a mechanical arm rotatable about pivot 74, is shown in three positions. The solid line view of sensor 72 represents a triggered position. The hidden line views of the sensor 72 represent a closed, non-triggered position where no paper is present and an open position showing how the sensor moves out of the way to allow the media to pass. In one embodiment, the sensor 72 is spring biased to the closed position. During operation, a leading edge of a media sheet traveling along paths 60-63 contacts and displaces the sensor 72 to the triggered position where the sensor activates a switch, which may be optical, electrical, or mechanical in nature. In one embodiment, the switch is a mechanical switch 78 that is activated by a leaf spring contact 76. In another embodiment, sensor 72 may be rotated into or out of the path of a photointerrupter (not shown) to detect the position of sensor 72. The sensor 72 may also be configured to sense a condition when media traveling along all media paths 60-63 is a common distance R away from the focal point 70. Thus, the various timing events may advantageously begin at a similar starting point, regardless of whether media arrives from conduit 64 or duplex path 30.

Figure 5:
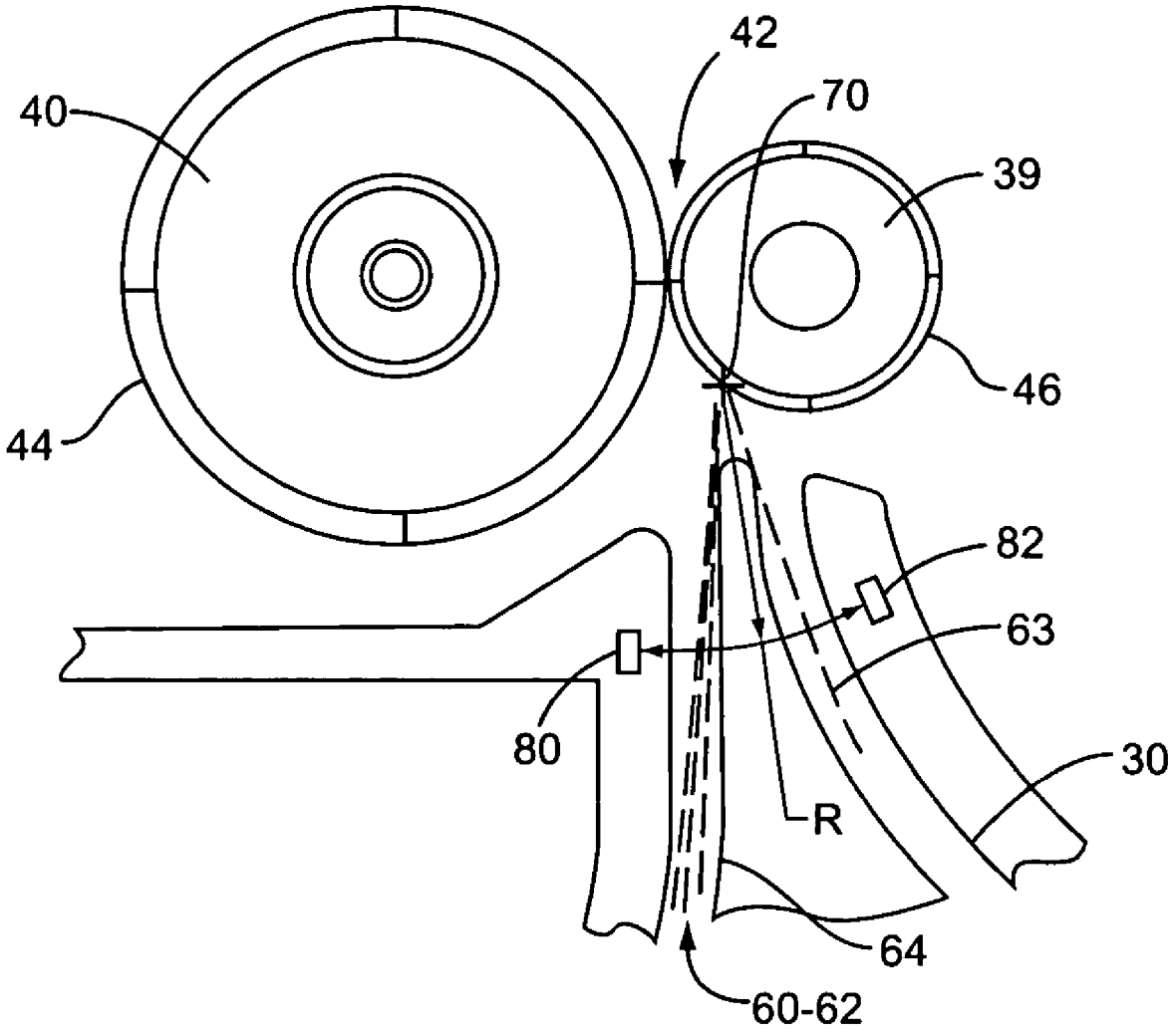
FIG. 5 is a schematic illustration of a media feed sensor in the vicinity of an alignment nip according to one embodiment of the present invention.

In an alternative embodiment shown in FIG. 5, the mechanical sensor 72 may be replaced with one or more optical sensors 80, 82. As with the embodiment shown in FIG. 4, the sensors 80, 82 are positioned to trigger when media reaches a common distance R away from the focal point 70. The sensor 80, 82 may be discrete sensors with sensor 80 detecting the presence of media following paths 60-62 and sensor 82 detecting the presence of media following path 63. Alternatively, the sensors 80, 82 may be components of a single, integrated sensor. For instance, sensor 80 may be an optical, magnetic, or acoustical transmitter and sensor 82 may be a corresponding receiver (or vice-versa). Thus, the trigger points for media following paths 60-62, 63 would exist along a straight line between emitter 80 and receiver 82 and may still suitably approximate a common time of leading edge approach to focal point 70.

The present invention may be carried out in other specific ways than those herein set forth without departing from the scope and essential characteristics of the invention. For instance, the embodiments described have been depicted in use with a diversion 66 within an elongated media conduit 64. The diversion 66 and conduit 64 may also be integrated into a short guide through which media passes. It is also possible to implement one-sided deflecting plate as a suitable diverting jog. Still another possibility is the use of a series of jogs to achieve the intended diversion. The present embodiments are, therefore, to be considered in all respects as illustrative and not restrictive, and all changes coming within the meaning and equivalency range of the appended claims are intended to be embraced therein.

What is claimed is:

1. An image forming device comprising:

a vertical media path through which media sheets originating from a plurality of sources pass, at least one of the plurality of sources being on a first lateral side of the vertical media path and a second of the plurality of sources being on a second lateral side of the vertical media path, at least two of the plurality of sources being located at a common vertical position on the vertical media path;

an alignment mechanism located along the media path, the alignment mechanism comprising first and second rollers;

a diverter positioned along the vertical media path upstream of the alignment mechanism and vertically below the alignment mechanism to horizontally alter the course followed by the media sheets and focus an approach of the media sheets such that the media sheets originating from each of the plurality of sources make initial contact with the alignment mechanism at a common predetermined position, the diverter being a portion of the media path and being stationary irrespective of the plurality of the sources from where the media sheet is being picked, the diverter being positioned proximally to the alignment mechanism such that no roller is positioned in the media path between the diverter and the alignment mechanism, a second media path through which media sheets originating from a secondary source other than the plurality of sources pass, the second media path configured to direct media sheets passing through the second media path to make initial contact with the alignment mechanism at the common predetermined position, the second media path positioned upstream of the alignment mechanism and downstream from the diverter.

2. The image forming device of claim 1 wherein the diverter extends into the media path.

3. The image forming device of claim 1 wherein the diverter is configured to focus an angle of approach of the media sheets to the alignment mechanism.

4. The image forming device of claim 1 wherein the first and second rollers form an alignment nip and the common predetermined position is at the alignment nip.

5. The image forming device of claim 1 wherein the first and second rollers form an alignment nip and the common predetermined position is a position on the first roller upstream of the alignment nip.

6. The image forming device of claim 1 wherein the common predetermined position is an area on the second roller upstream of an area where the first and second rollers contact each other.

7. The image forming device of claim 1 wherein the common predetermined position is at the roller having a lower coefficient of friction relative to the media sheets.

8. The image forming device of claim 1, wherein a lower portion of the diverter includes a jog which extends laterally further into the vertical media path than any other portion of the diverter so as to cause contact with media sourced from at least one of the plurality of sources.

9. An image forming device comprising:

a metering device comprising first and second rollers forming a nip;

a first media path through which media sheets from a first source travel to the metering device;

a second media path through which media sheets from a second source travel to the metering device, the second media path having a different approach angle into the metering device than the first media path;

the first and second media paths each being vertically below the metering device and having an associated guide configured to contact a leading edge of the media sheets moving along the first and second media paths and direct the media sheets to initially contact a common point at the metering device, the first media path leading into the guide from a first lateral direction and the second media path leading into the guide from a second lateral direction;

the first source located on a first lateral side of the guide and the second source located on a second lateral side of the guide;

the first and second sources being positioned at a common vertical distance from the metering device;

the guide being positioned along the first and second media paths and vertically below the metering device; and a third media path through which media sheets from a third source travel to the metering device, the third media path positioned upstream of the metering device and vertically above the guide, the third media path configured to direct a leading edge of the media sheets passing through the third media path to initially contact the common point at a metering device, the guide being a portion of the media path and being in a fixed position irrespective of the plurality of the sources from where the media sheet originates, the guide being positioned relative to the metering device such that no rollers are positioned between the guide and the metering device.

10. The image forming device of claim 9 further comprising a leading edge sensor associated with each media path, the leading edge sensor associated with each media path adapted to trigger when a leading edge of a media sheet traveling through the first media path or the second media path passes a substantially common distance away from the common point at the metering device.

11. The image forming device of claim 10 wherein the leading edge sensor associated with each media path comprises a mechanical sensor.

12. The image forming device of claim 11 wherein the mechanical sensor comprises a single arm adapted to deflect when the leading edge of the media sheet traveling through the first media path or the second media path contacts the arm.

13. The image forming device of claim 10 wherein the leading edge sensor associated with each media path comprises an optical sensor.

14. The image forming device of claim 9, wherein the associated guide directs the media sheets to initially contact a common area on the first roller prior to the media sheets contacting the second roller.

15. The image forming device of claim 9, wherein the associated guide directs the media sheets to initially contact a common area on the second roller upstream of an area on the second roller which contacts the first roller.

16. The image forming device of claim 9, wherein the associated guide directs the media sheets to initially contact a common point at the nip.

17. The image forming device of claim 9, wherein the associated guide directs the media sheets to initially contact a common point at a roller of the metering device having a lower coefficient of friction relative to the media.

18. The image forming device of claim 9 further comprising a common media path through which media sheets from the first media path and second media path travel prior to reaching the metering device.

19. The image forming device of claim 9, wherein a lower portion of the associated guide includes a jog which laterally extends relative to the first and second media paths further than other portions of the associated guide.

* * * * *